United States Patent [19]

Howard

[11] Patent Number: 4,511,321

[45] Date of Patent: Apr. 16, 1985

[54] DENSIFICATION - PELLETIZING OF ORGANIC MATERIALS

[76] Inventor: Glenn Howard, 9893 Hwy. 41 N., Madera, Calif. 93637

[21] Appl. No.: 379,663

[22] Filed: May 19, 1982

[51] Int. Cl.[3] ..... B28B 5/00

[52] U.S. Cl. ..... 425/331; 425/DIG. 230

[58] Field of Search ..... 425/312, DIG. 230, 313, 425/331; 100/8, 907; 76/107 R

[56] References Cited

U.S. PATENT DOCUMENTS

| | | | |
|---|---|---|---|
| 2,171,039 | 8/1939 | Meakin | 425/DIG. 230 |
| 2,215,435 | 9/1940 | Hale | 425/313 |
| 2,290,752 | 7/1942 | Hurxthal et al. | 425/331 |
| 2,565,830 | 8/1951 | Weston | 425/331 |
| 2,757,621 | 8/1956 | Johnson | 425/DIG. 230 |
| 2,778,323 | 1/1957 | Money | 425/311 |
| 2,813,299 | 11/1957 | Massey | 425/362 |
| 2,904,827 | 9/1959 | Kaiser et al. | 425/312 |
| 3,016,026 | 1/1962 | Sorensen | 425/DIG. 230 |
| 3,144,840 | 8/1964 | Crane | 425/DIG. 230 |
| 3,295,469 | 1/1967 | Jassalli | 425/313 |
| 3,394,646 | 7/1968 | Cunningham | 425/313 |
| 3,430,583 | 3/1969 | Pool et al. | 425/362 |
| 3,627,865 | 12/1971 | Wittwer et al. | 264/141 |
| 3,874,835 | 4/1975 | Rossiter et al. | 425/313 |
| 4,281,976 | 8/1981 | Nichols | 425/331 |
| 4,297,091 | 10/1981 | Strefling | 425/DIG. 230 |

FOREIGN PATENT DOCUMENTS

| | | | |
|---|---|---|---|
| 1464146 | 12/1966 | France | 425/331 |

*Primary Examiner*—Jay H. Woo
*Assistant Examiner*—Joye L. Woodard
*Attorney, Agent, or Firm*—Herzig, Schaap & Yanny

[57] ABSTRACT

A machine for densifying and pelletizing extrudable material is disclosed. The machine includes, in combination, a flat horizontal die plate and pressure exerting means overlying the die plate, the pressure exerting means having various, alternative forms such as a continuous chain means carrying a plurality of spaced pressure members or a reciprocating frame carrying roller means.

13 Claims, 13 Drawing Figures

34
56
74
2
3
4
45
80
84
14
20
124
58,58a
59
100
116
28
38
12
74a
32
110
74b
156
154
91
92
90
10
74c
104
120,94
121'
140
143
142
144
148
150
152
+
-

DENSIFICATION - PELLETIZING OF ORGANIC MATERIALS

BACKGROUND OF THE INVENTION

1. Field of the Invention

The field of the invention relates to organic material and especially to equipment for densifying this material, particularly pelletizing the material to put it into a form faciliating its use. The invention is particularly adapted to bio mass materials, but is not limited thereto being adapted to the pelletizing of other materials such as human and animal food products.

2. Description of the Prior Art

The invention involves, particularly, improvements in machinery for densifying and pelletizing bio mass material. Accordingly background in that area is provided.

The nature and source of organic materials suitable as sources of fuel are well known in the art, this being elucidated in patents such as U.S. Pat. Nos. 3,227,530; 3,492,131; and, 4,015,951. Apparatus or machines for pelletizing bio mass material generally follow a typical type of construction such as that shown in FIGS. 2–5 of U.S. Pat. No. 4,211,740. Typically the known pelletizing mills are of a rotary construction wherein a rotary die or dies rotate within a cylindrical housing or drum to compact and densify the bio mass material, the process involving changing the direction of flow of the bio mass material through 90° to force it through orifice plates in which the pellets are formed.

In general the object or goal involved in the handling and pelletizing of bio mass material is to realize practical moisture removal, to place the material in a form adapted for economical transportation and purported cell fracture to allow better combustion in solid form or when pulverized for combustion in suspension.

The present state of the art as shown presents multiple problems. As indicated in the foregoing the typical type of apparatus utilized for densification and pelletizing consists of a rotary die which rotates relative to rollers which are supplied with pulverized bio mass material which is forced through a series of holes or orifices results in extruded densified pellets. The process as utilized has evolved from a system and apparatus long used for the pelletizing of food and feed products. The adaptation of this known apparatus and process for fuel production has effected and resulted in little change in the machine beyond strenthing gears, shafts, shear pins, etc., to withstand the great pressure and friction consistent with bio mass which product does not have the inherent natural lubricants of feed and food products and is subject to higher pressure required to produce a satisfactory fuel. The leading edge of technology available is perhaps the machine known as C.P.M. 8000, but even at the leading edge of the technology there are present serious shortcomings affecting the economic practicality of producing a satisfactory marketable fuel, the shortcomings being present particularly because of energy considerations as pointed out hereinafter.

The following points out principal drawbacks and deficiencies inherently present with respect to the present state of the art.

A particular deficiency with respect to known apparatus has to do with electrical energy requirements. There can be considered a machine of the type as identified in the foregoing having a main driving motor of 500 H.P., drawing 600 amperes which can produce at the rate of from $5\frac{1}{2}$ to 10 tons per hour of densified pellets. A computation of the amperage, that is, current draw per hour in relation to the resulting production of fuel in tons will indicate an electrical energy cost per ton in proportion to the BTU recoverable energy at the time of combustion such that the energy relationships make the process almost, if not economically not practicable.

Another draw-back involved with respect to the conventional machinery is the original capital cost. For example, the rotary die may weigh 800 pounds and must be revolved or spun at a speed of 900 RPM. This necessitates a very heavy and costly gear train to reduce the 1700 RPM of the 500 H.P. motor to the slow die speed. The speed reduction itself results in an energy loss.

A further drawback to the conventional machinery involves the costs of replacing expendable parts. Typically there is an unacceptable die and roller shell replacement cost related to economic working life produced by bio mass friction involved in the flow direction change of the bio mass material and the unfavorable attitude of introduction of bio mass material in the densification chambers. This physical circumstance has been disclosed by careful examination of the machinery and die sections after use. There is an undesirable physical flow pattern that takes place that operates to destroy dies and rollers much too fast and which circumstance also consumes an inordinate amount of electrical energy manifested by the kinetic energy developed which is transformed into heat resulting in saturated steam released by the pellets after passing through the die. This heat is an unacceptable costly form of thermal energy which in its electrical energy form is even greater than the resistance heat.

Another factor is that of bio mass moisture requirement. Experience in the field has revealed that the moisture content of the bio mass for processing in existing systems is too limited for optimum economic production of fuel pellets in the range of 12% to 13% of moisture as required resulting in balance of plant operation dictated by pellet machine moisture requirements.

Typical prior art machines as identified in the foregoing involve substantial production down time due to the necessity to replace dies, adjust rollers, etc. To produce a satisfactory quality in the pelletized fuel, roll adjustment is necessary. This adjustment is slow, difficult and dangerous. If not done on a timely basis and if not done correctly the result will be an unsatisfactory pellet or a gross reduction in die and roller economic life.

The introduction of raw material into the pelletizing apparatus is extremely important and critical. The required pressure for a satisfactory densification of bio mass as indicated in the foregoing has required the use of massive rollers and a reinforced die plus an extra roller to partially distribute forces generated in an attempt to alleviate the flexing of the die. This significantly complicates the even distribution of the raw material across the face of the die resulting in uneven extrusion of pellets, causing power loss related to production volume and shortens die and roller economic life. The physics involved in trying to feed a round spinning die evenly and to equally feed two or more rollers is at best very difficult as is evidenced by the variety of feed mechanisms and "plows" that have been experimented with in the past.

The metallurgy of the parts involved in the apparatus is extremely significant. Metals have been developed for the glass industry as well as other processes that could far better withstand the abrasiveness of bio mass material. However, to date it has not been economically praticable to cast these materials and machine them for application in presently known pelletizing systems. This has dictated selection of raw material more critically then would be desireable if the die and rollers could be fabricated from a material that would withstand more abrasive raw material without increasing replacement of parts, require more critical moisture control or increase energy requirements.

The herein invention, an exemplary form of which is described in detail hereinafter seeks to make available densifying equipment for bio mass or other material constructed in accordance with unique concepts so as to overcome all of the above identified drawbacks and deficiencies of the prior art. The objectives to be attained by the herein invention are identified with particularity hereinafter.

SUMMARY OF THE INVENTION

The invention in the exemplary form described hereinafter resides primarily in an apparatus or machine for densifying and pelletizing bio mass material. What bio mass material is, and what it constitutes is readily understandable from the foregoing description and references to the prior art. The apparatus or machine of the invention that densifies and pelletizes the bio mass material may be referred to as a mill.

Although the exemplary form of the invention is described as an apparatus for processing bio material it should be expressly understood that the invention is not limited to use with bio mass material, but is equally adaptable to other materials such as human and animal food products and in fact any type of product requiring densification and pelletization.

The bio mass material after being obtained and subjected to preliminary treatments which may correspond to preliminary treatments as utilized in the prior art is fed into the machine and then densified by pressure and then pelletized by being extruded through orifices. In the machine of the invention there is provided a flat horizontal die plate with the extrusion orifices in it. An apparatus is provided for exerting pressure on the bio mass material on the die plate for densifying it and forcing it through the die orifices which are at an angle for purposes of lessening or minimizing the change in direction of the bio mass material as it is being extruded in order to limit the expenditure of energy and conversion of such energy into heat. In a preferred form of the invention the apparatus for accomplishing these purposes takes the form of spaced link belts or chains at opposite sides of the machine which pass over toothed wheels at the ends of the link belts or chains. The construction corresponds roughly to that of the treads of a caterpillar tractor or to tank treads. Carried between the link belts are spaced pressure rollers having surfaces which are parallel to the surface of the die plate in a position to exert pressure on the bio mass material.

Overlying the lower reach of the link belt on each side of the machine is a pressure plate which engages the lower reach of its respective link belt. Pneumatic or hydraulic cylinders are provided for urging the pressure plates downwardly so that force is exerted on the ends of the shafts of the pressure rollers to urge the rollers downwardly against the bio mass material to densify it and force it through the orifices in the die plate.

Preferably associated with each of the pressure rollers and carried behind each roller by the spaced link belts are scraper members or plows which will scrape up the bio mass material remaining on the surface of the die plate, this material being then carried upwardly at the end of the machine and allowed to drop back downwardly on to the die plate.

An alternative form of the invention is provided wherein a mechanism which is alternative to the pressure rollers is utilized to exert force on and to densify the bio mass material. In this form of the invention instead of the rollers transverse curved shoes are provided which are supported and carried by links of the respective link belts, the shoes being positioned at intervals along the length of the link belts. The shoes are carried in a position such that by reason of their configuration they exert a downward force on the bio mass material to densify it and force it through the orifices in the die plate.

In a modified form of the invention, the rollers for densifing the bio mass material rather than being carried on endless belts or chains are carried on a reciprocating frame which is preferably reciprocated by way of a pressure cylinder which may be either pneumatic or hydraulic. In this modified form of the invention preferably a cam and cam follower structure is provided so that the frame carrying the rollers makes a densifying stroke in one direction and then is lifted by the cam and follower mechanism during the return stroke.

In this form of the invention hold down means are provided for urging the frame and rollers downwardly towards the die plate during the densifying stroke. The cam and follower structure includes cam plates having cam tracks fromed in them to be followed by the cam followers, the plates being guided for a vertical, that is, up and down movement. Pressure cylinders are provided for the application of hold down pressure to the guide plates. In both forms of the invention pressure fluid is provided to the hold down cylinders under the control of valve means. Proportioning control mechanism is provided for controlling the pressure in the hold down cylinders in response to pressure sensors whereby a predetermined set, adjustable hold down force can be provided in the hold down cylinders which are arranged in pairs.

The pressure cylinder which reciprocates the frame carrying the rollers is a double acting cylinder which as stated may be pneumatic or hydraulic and which is electrically controlled by way of switches which are actuated by reciprocating movement of the frame carrying the rollers the switches controlling relays which in turn control valves controlling the flow to and the release of actuating fluid with respect to opposite ends of the cylinder. The controls for the hold down cylinders in this form of the invention include release valves which are electrically controlled by way of switches actuated by movements of the frame causing the pressure in the hold cylinders to be released when the frame is to be moved upwardly for its return stroke.

The following identifies with particularity the objectives sought to be achieved by the herein invention.

A primary object is to realize a material densifier or pellet mill having the capability of producing in excess of ten tons of high quality pellets per hour with hose power requirements limited in optimum conditions to as little as 150 H.P.

An object of the invention is to make available a machine utilizing a flat die plate with orifices and overlying mechanism in the form of rollers which are moved along the die plate to densify and compress the material and to extrude it through the die orifices which are at an angle to the die plate to minimize or limit the change in direction of the material being extruded.

A further object is to provide machinery as in the foregoing including roller means carried on an endless chain or belt with means to provide hold down force on the rollers densifying the material on the die plate.

Another object is to realize a machine wherein the densifying rollers are carried on a frame which is reciprocated with means whereby the frame and the rollers apply pressure to the material on the die plate when moving in one direction.

A further object is to make available automatic controls for controlling hold down forces applied to the rollers which act on the material on the die plate and to provide automatic control means for reciprocating the frame which carries the densifying rollers.

Another object is to eliminate in a densifier and pelletizer the need for heat to be generated by friction and pressure by heating the pelletizing die by means of steam jackets or electrical heaters. A correlary objective is to heat the material (if bio mass) allowing higher moisture content of the raw material so that the electrical energy which in the prior art is converted to thermal application is instead utilized as an extrusion force.

A further basic object is to realize reduction in production cost of the apparatus. This object includes the object of realizing a simple design; more open tolerances; automatic adjustment capabilities; as well as adapting the equipment to use of less costly necessary ancillary equipment such as starters.

A further object is to realize reduced costs of replacing expendable parts. A correlary to this object is that of increasing the economic life of dies and rollers of shoes to make these items less costly to produce. A further object is to adapt these parts to the utilization of more exotic metallurgy to materially reduce replacement part costs per ton.

A further object of the invention is to alleviate the critical moisture content characteristics in the case of bio mass material introduced to the machine characteristic of prior art apparatus. A correlary object is to realize this primary objective by the introduction of thermal energy directly to the material, especially bio mass fiber by means of steam jackets or electrical heaters or other comparable means. This contrasted to the presently known expensive manner of deriving heat from kinetic energy of movement in the apparatus. A further correlary object is to overcome the existing necessity for critical moisture content in the case of bio mass material introduced to the process by off setting it by way of the availability of adjusting temperature introduced other than by pressure and friction.

Another primary object is to reduce production down time. A correlary object is to realize this primary objective by the use of sensors which may include temperature, moisture, pressure and flow rate, which with the addition of signal transmitters and feed back arrangements will be self adjusting. A further object is to reduce down time for adjustment by the provision of pneumatic or hydraulic cylinders capable of performing the function of allowing for wear, variations in bio mass characteristic moisture content and densification criteria. A further correlary object is to eliminate the dangers attended to adjusting the available equipment and consequences of bodily harm.

A further object relates to the introduction of raw material. The invention utilizes a stationary flat die with the result that the object is realized that it becomes a simple matter of distribute the raw material especially in the case of bio mass evenly over the face of the die in advance of the motion of the roller or shoe as referred to in the foregoing. This makes possible the realization of the further object of eliminating the complication of the centrifugal forces inherent in known state of the art machines using rotating rollers.

Another object is to realize the capability of the use of almost any material in the die to thereby permit the utilization of metallurgically perferable materials and compounds.

A further object is to construct the die with an entry section as a separate overlay so that that portion can be replaced without removal of its supporting member and thus replacement cost can thereby be substantially reduced.

Further objects and additional advantages of the invention will become apparent from the following detailed description and annexed drawings.

DESCRIPTION OF A PREFERRED EMBODIMENT AND BEST MODE OF PRACTICE OF THE INVENTION

Figures 1, 5:
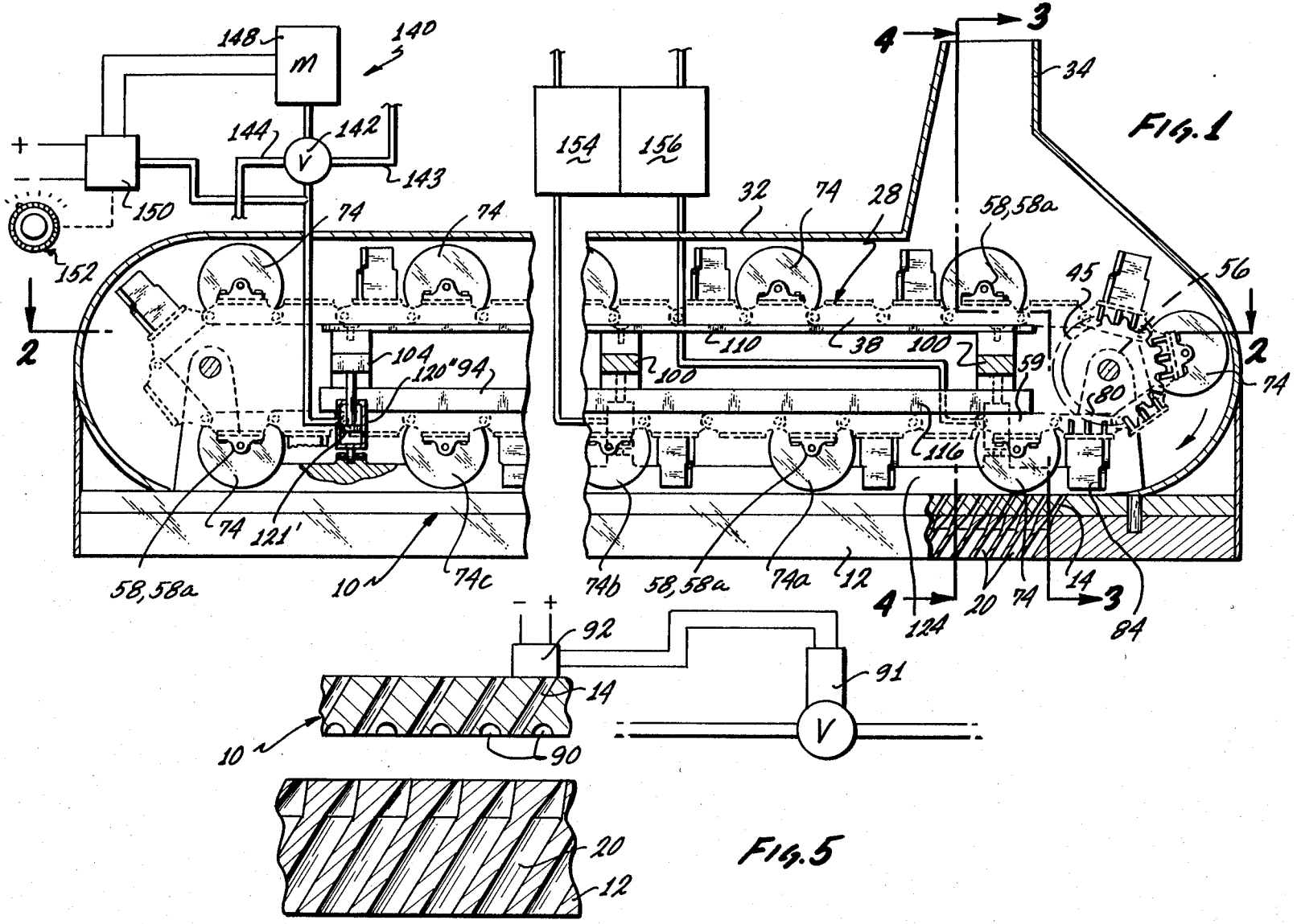
FIG. 1 is a side view partially in section of a preferred form of the invention.
FIG. 5 is a partial detail side elevational view of the system for applying heat to the die plate.

This description refers to bio mass, but other materials can be processed as referred to in the foregoing.

Referring to FIGS. 1, 2, 3, and 4 of the drawings numeral 10 designates the die plate which directly overlays base 12 which is at the bottom of the machine. The die plate 10 is constructed of a suitable material, reference to which has been made in the foregoing. It is significant that die plate 10 is a flat plate which overlies the support plate or base plate 12. The die plate 10 as shown has die orifices 14 which are spaced from each other and which are at an angle as shown for reasons which will be described presently. Die orifices 14 are aligned with openings or bore 20 in this support plate 12 which are at the same angle with the die orifices 14 for purposes as will be described.

Overlying the die plate 10 are a pair of continuous link chains or belts which carry pressure rollers which press on the bio mass material to densify it to force into the die orifices 14. The link belts and the pressure roller assemblies are identified by the numerals 28 and 28*a*. See FIG. 2.

The machine including the die plate 10, the support plate 12 and the link chains 28 and 29*a* are enclosed within a housing 32 having an inlet chute or feed hopper as designated by the numeral 34.

The feed chute or feed hopper 34 feeds into the right end of the housing as shown in FIG. 1 and as will be described more in detail presently.

The link chain or belt 28 (FIG. 1) is of generally conventional construction, number 38 designating an individual link, the links being pivotally attached to each other as shown. See FIG. 8. The links of the link chain may be constructed of suitable material for the purpose. Each link is provided on the inside thereof with projections or teeth 40 adapted to mesh with teeth of drive wheels or gears. Each also has a central web members for attachment to adjacent links.

At each end of the chain or belt 28 it passes over drive wheels or gears as shown at 44, 44*a*, 45, and 45*a*. See FIGS. 2 and 3. The gears over which the link chain passes are constructed as double gears, as may be seen in FIGS. 2 and 3, thereby being a pair of gears as designated at 44 and 45 which are carried on a shaft 50 extending from a pedestal 56. The gears 44 and 45 mesh with links like the link 38 as may be seen in FIG. 3. Gears 44*a* and 45*a* are on shaft 50*a* extending from pedestal 56*a*.

The gears at the opposite end of the link chain or belt are similar, these gears being mounted on shafts. The shaft 50 is is supported in a pedestal 56.

Certain links in the chain or belt 28 at spaced points carry pillow blocks for supporting shafts as will be described. Numberal 58, FIG. 1, designates one of the pillow blocks of the link chain as may be seen in FIGS. 1 and 3. The chain 28*a* on the opposite side of the machine, of course, has a pillow block 58*a*. Journalled in these pillow blocks is a transverse shaft 68 which carries a cylindrical roller 74. This roller is a pressure roller that densifies the bio mass material forcing it into the die orifices 14 as will be described. As may be seen the bio mass material enters by coming down through the chute or hopper 34 and can come down between the drive chains at the side of the machine and down on to the die plate 10 as will be described more in detail hereinafter.

Figure 2:
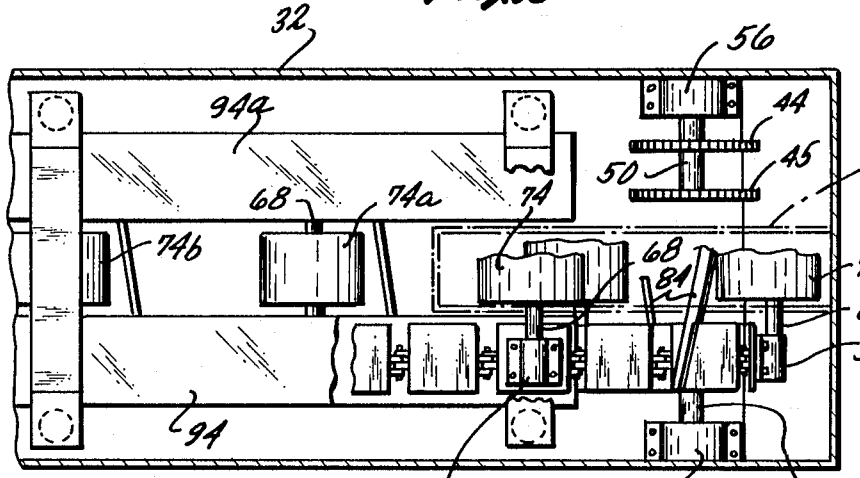
FIG. 2 is a longitudinal sectional view taken along the line 2—2 of FIG. 1.

As may be seen in FIGS. 1 and 2, similar pressure rollers are attached at intervals all along the length of the drive chains or belts 28 and 28*a*. The drive rollers along the lower reach of the drive chains are designated by the characters 74, 74*a*, 74*b*, 74*c*, and 74*d*, in FIG. 2. In the construction shown the drive rollers are attached to every fourth pair of links in the drive chains.

Referring to FIG. 1 the link just behind the link 59 is designated by numeral 80. The chain on the opposite side 28*a*, of course, has a corresponding link 80*a*. Attached to and carried by the link 80 and a link on the opposite side in the chain 28*a* is an angular plow or scraper member 84. This member is to the rear of the roller 74 as shown and serves an important function. In operation, as will be described, downward force is being exerted along the length of the lower reachs of the chains 28 and 28*a*, this force being transmitted to the rollers 74 so that the rollers exert pressure on and densify the bio mass material and force it into the orifices 14. Significantly the orifices 14, as state above, are at an angle rather than being normal to the orifice plate 10 so that the direction of movement of the bio mass material is not changed through 90°, but through an angle less than 90°. Bio mass material that remains on the surface of the die plate 10 after the roller 74 passes is picked up or scraped up by the member 84 and then drawn along the surface, and is eventually carried up at the end of the chains 28 and 28' and then is allowed to drop down again to fall back onto the surface of the die plate 10. Similar plow or scraper members are provided in association with each of the rollers 74, all of them operating in the same manner.

In addition to the function of the members 84 as described above, they tend to smooth out the surface of the bio mass material ahead of the next roller behind the plow member. Also, preferably these plow members are made adjustable permitting a variation in the depth of the material being pelletized.

Figures 3, 4, 8:
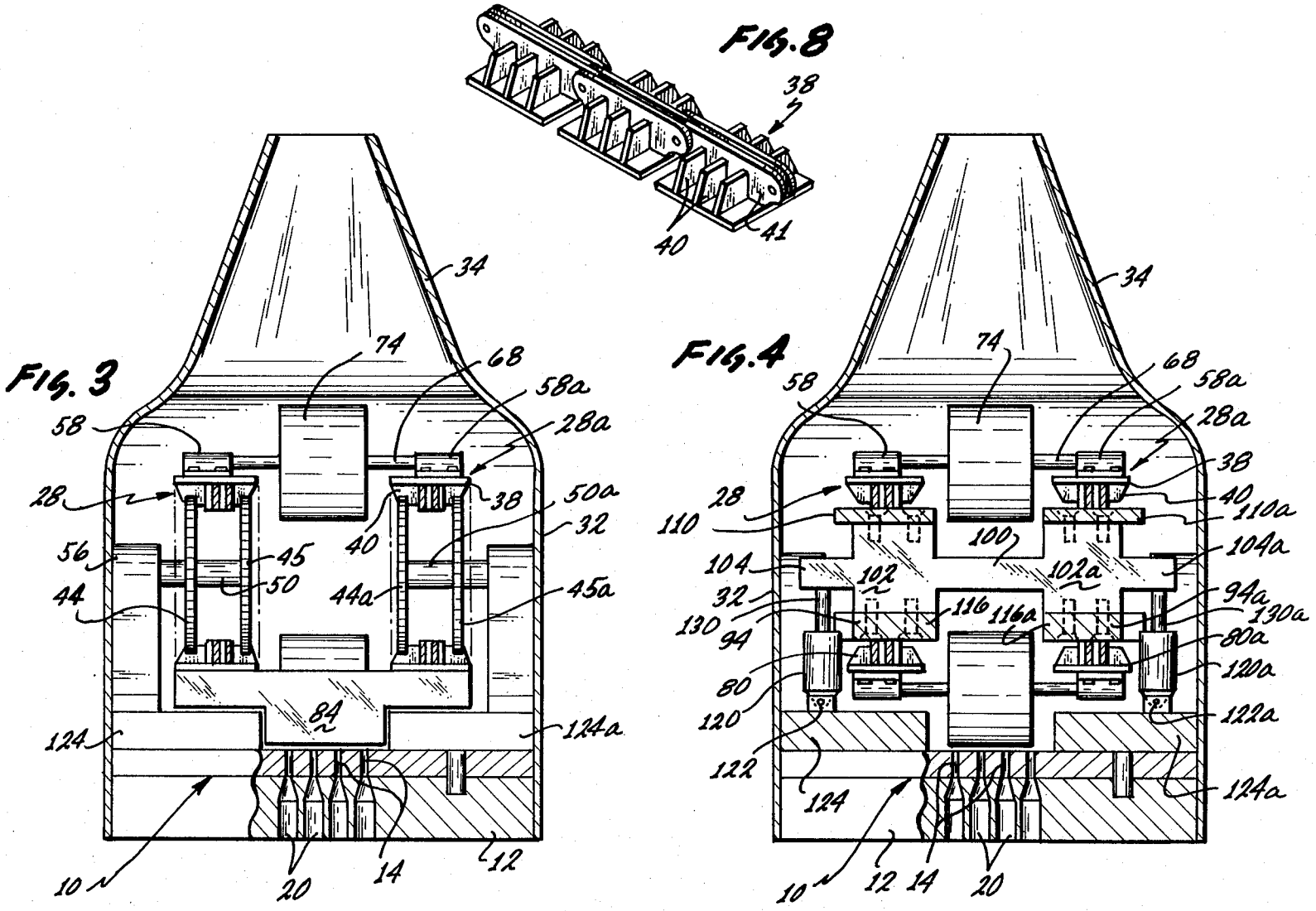
FIG. 3 is a vertical sectional view of the machine of FIG. 1, taken along the line 3—3.
FIG. 4 is a sectional view taken along the line 4—4 of FIG. 1.
FIG. 8 is a detail isometric view of the links of the endless chain.

FIG. 4 is an enlarged sectional view of a portion of the die plate 10 and the support plate 12 illustrating the orifices 14 and the channels 20 more in detail. As may be seen in FIG. 5 in addition to the channels 20 there are a plurality of grooves or indentations as designated at 90 which are formed in the bottom of the plate 10. The open side of these channels fits against the plate 12 providing passage ways for flow of a heating agent such as steam whereby the orifice plate and the support plate 12 can be heated to a suitable temperature which is applied to the bio mass material for controlling the moisture content. Alternatively, electrical heaters such as CALRODS can be embedded in one or both of plates 10 and 12. Heating fluids is controlled by proportioning valve 91 under control of sensor 92.

As explained in the foregoing the lower reach of the belts or chains 28 and 28*a* has pressure applied to urge the pressure rollers 74 against the bio mass material to densify it and to extrude it through the die orifices 14. In a preferred construction normally there is a very slight clearance provided between the rollers 74 and the die plate 10, this clearance being in an amount comparable to the thickness of a plastic playing card or the like.

Numeral 94 in FIG. 1 designates a pressure plate which overlays the lower reach of the chain belt 28, the chain belt being in direct contact with this pressure plate. As may be seen in FIG. 2 a similar pressure plate 94*a* overlays the lower reach of the other link belt 28*a* and is in contact with it. Pressure cylinders which may be either pneumatic or hydraulic are provided for urging the pressure plates 94 and 94*a* downwardly so as to urge the lower reach of the link belts and the pressure rollers carried by the link belts down against the bio mass material.

Referring to FIG. 4 numeral 100 designates a transverse member which is positioned between the upper and lower reaches of the link chains 28 and 28*a*. The transverse member 100 has vertically broadened parts 102 and 102*a*. Extending from the part 102 is a lug 104 and extending from part 102*a* is lug 104*a*.

As will be explained presently there are three pairs of hold down cylinders on opposite sides of the machine which operate to apply downward force to the lower reaches of the link chains 28 and 28*a* and to the rollers. There are three transverse members like the transverse member 100 all of which are alike, as will be referred to again presently.

Numeral 110 designates a plate carried at the top of broadened part 102 and numeral 110*a* designates a similar plate carried at the upper end of broadened part 102*a*. Plates 110 and 110*a* are also supported by the additional transverse members like the member 100. The upper reaches of the link chains 28 and 28*a* ride on the plates 110 and 110*a*.

Numeral 116 designates a pressure plate carried at the bottom of broadened part 102 and numer 116*a* designates a pressure plate carried at the bottom of broadened part 102*a* of the member 100. As will be explained the pressure plates 116 and 116*a* exert pressure on the lower reaches of the link chains 28 and 28*a*. The plates 110, 110*a*, 116 and 116*a* are similarly attached by screws. As explained in the foregoing there are three members like the transverse member 100 that supports the upper plates 110 and 110*a* and the pressure plates 116 and 116*a*.

Pairs of pressure cylinders are provided having stems which are attached to the lugs on the transverse member 100 for exerting a downward force so that the pressure plates 94 and 94*a* exert force on the lower reaches of the link chains 28 and 28*a* which in turn cause force to be exerted by the rollers 74 and against the material being pressued against the die plate 10. A pair of such hold down cylinders is provided for each of the transverse members 100.

In FIG. 4 a pair of hold down cylinders is designated by the numerals 120 and 120*a*. The cylinder 120 has a pivotal support 122 at the bottom which is above support member 124 allowing slight lateral angular movement of the cylinder. The cylinder 120*a* has similar pivotal support 122*a* mounted on member 124*a*.

The cylinder 120 has a stem 130 and cylinder 120*a* has a stem 130*a*, the stems being attached to the lugs 104 and 104*a*.

Fluid is supplied to the cylinders so that a hold down pressure or force is exerted on the transverse member 100 and the other transverse members so that the pressure plates 94 and 94*a* can exert downward pressure on the link chains and on the rollers.

As stated there are three pairs of hold down cylinders like the cylinders 120 and 120*a*. One of the cylinders is designated by the character 120″ in FIG. 1, this cylinder being one like those described in connection with FIG. 4.

A modulating or proportioning controlling system is provided for each of the pairs of hold down cylinders along the length of the chain and roller assembly. One of such systems is illustrated schematically at 140 in FIG. 1. Numeral 142 designates a three-way valve having inlet 143 and outlet 144 which connects to the cylinder 120″ which has a piston 121″. The three-way valve 142 has another outlet 144.

The valve 142 is positioned by a control motor 148 which is an electric motor responsive to a proportioning type control instrument or sensor designated by the numeral 150. The control system has its set point adjusted from a remote station by way of an adjusting knob, as designated at 152 which, of course, may be part of a control panel or a control console. It is to be understood that additional control instrumentalities can be provided if desired, so as to realized additional control in response to moisture content in the material being pelletized, or flow, or otherwise.

The control system 140 operates to maintain the set pressure in the hold down cylinders, that is, that hold force which is a predetermined value as set by the knob 152.

Numeral 154 designates a system like the system 140 for controlling the pressure in the intermediate pair of hold down cylinders. Numeral 156 designates another similar system which controls the hold down force in the third pair of hold down cylinders.

From the foregoing description of FIGS. 1 through 5 those skilled in the art will readily understand the construction of this embodiment of the invention and the manner in which it operates. The material to be densified and pelletized enters through the chute 34 and descends down onto the die plate 10. The shaft of one or more of the gears which drives the link chains is driven by a motor not shown so that the link chains bearing the roller members operate at a desired speed drawing the rollers over the material on the die plate and pressing the material to pelletize it through the orifices 14 and 20. The scrapers or plow members 84 behind the rollers operate to scrape material not extruded through the die orifices and carry it up around the end of the housing 32 to again be placed on the surface of the die plate.

Controlled heating is applied to the die plate by the system as indicated in FIG. 5 so that heat resulting from kinetic energy does not have to be utilized in the process.

During operation the lower reaches of the link chains are held down by the pressure plates which are held down by the pairs of hold down cylinders which as explained are under control of the proportioning control systems so that the desired predetermined force is applied downwardly against the material being densified and pelletized.

Figure 6:
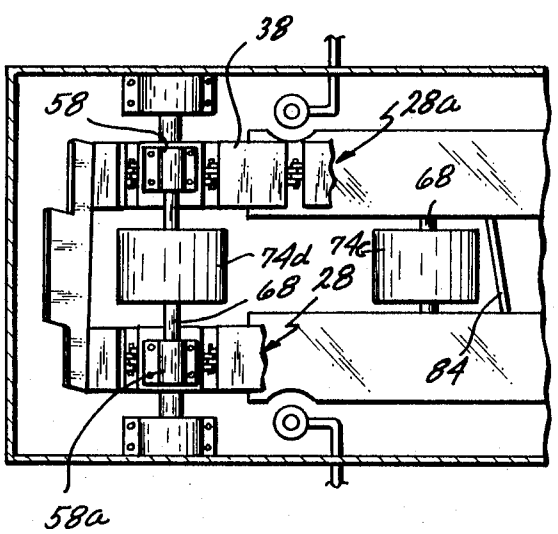
FIG. 6 is a partial sectional elevational view of a modified form of the invention.
Figure 6:
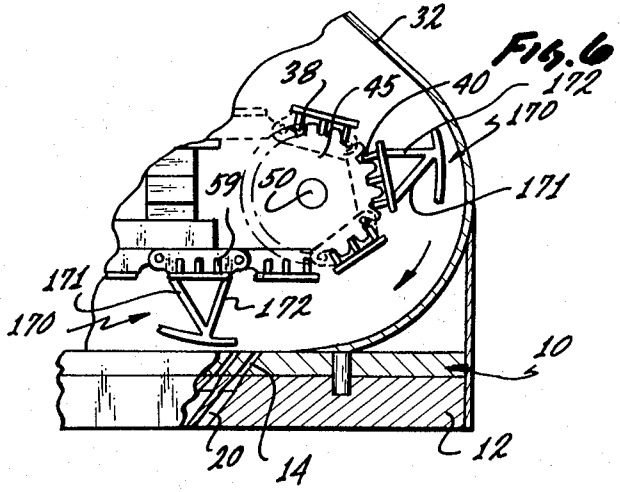

FIG. 6 shows a modified form of the invention which in all respects is like the previous embodiment except as follows. In this form of the invention the link chains do not carry rollers but instead they carry presser members or presser shoes, one of which is designated at 170. The shoe is a curved transverse member having slight curvature as shown so as to be able to press the material downwardly and to extrude it through the orifices, the presser plate or shoe 170 being attached to the link 59 by brace members 171 and 172. Preferably the shoe or presser member, like the member 170 is attached to every fourth link of the link chain.

This form of the invention operates like that of the previous embodiment with the exception that the pressing and extruding function is executed by the pressers or shoes 170 acting on the material rather than rollers.

Figure 7:
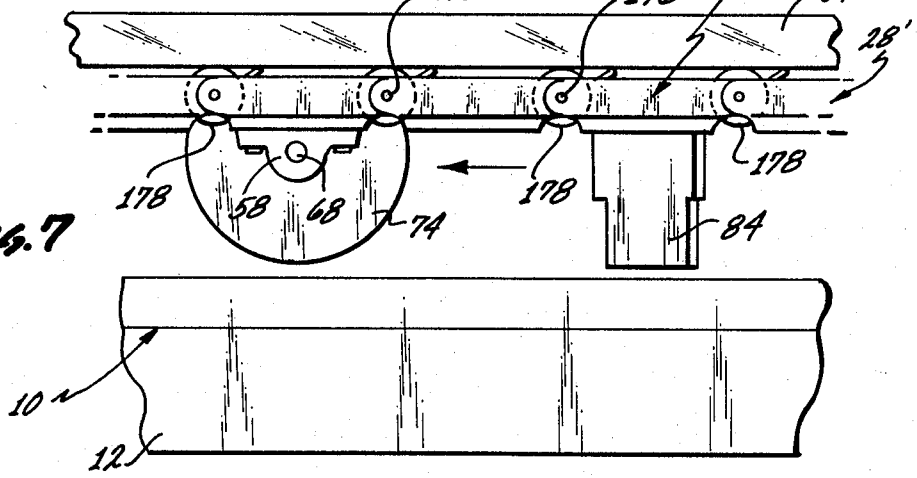
FIG. 7 is a partial view of another modified form of the invention.

FIG. 7 shows another modified form of the invention which is in all respects like that of the first embodiment, corresponding parts being identified by similar reference characters except as follows. One of the link chains is identified by the numeral 28′. One link is identified by the numeral 38′. The links are connected as in the previous embodiment by pivots or pivot stems, one of which is designated by the numeral 176.

On the stem 176 is provided a roller as designated at 178. If desired a pair of rollers can be provided one on each side of the chain. Similar rollers are provided on all of the pivots between adjacent links. These rollers ride against the pressure plate 94′ as may be seen in FIG. 7. As stated the structure is otherwise like that of the previous embodiment with the same controls of the hold down cylinders. The purpose of this form of the invention is to reduce or eliminate friction between reaches of the link chains and the pressure plates.

FIGS. 9–13 of the drawings illustrate another form or embodiment of the invention. This form of the invention has similarity to the first form of the invention in that it uses rollers which are pressed down against the material to be densified and pelletized with the difference that the rollers are not carried on endless link chains. Instead the rollers are carried on a frame which is reciprocated.

In these figures the housing is designated by the numeral 32′ and the inlet chute is designated at 34′. The housing has an end 190 and another end 192 formed by vertical walls. The die plate and the base 12 are like these elements of the first embodiment.

Numeral 198 designates a frame carrying rollers, as may be seen in FIGS. 9–13. The frame has side members 200 and 202. The left ends of the side members 200 and 202 can move vertically in slots 208 and 210 formed in the end wall 190. The right ends of the frame members 200 and 202 move vertically in slots 212 and 214 formed in the end wall 192. See FIG. 11.

Figure 12:
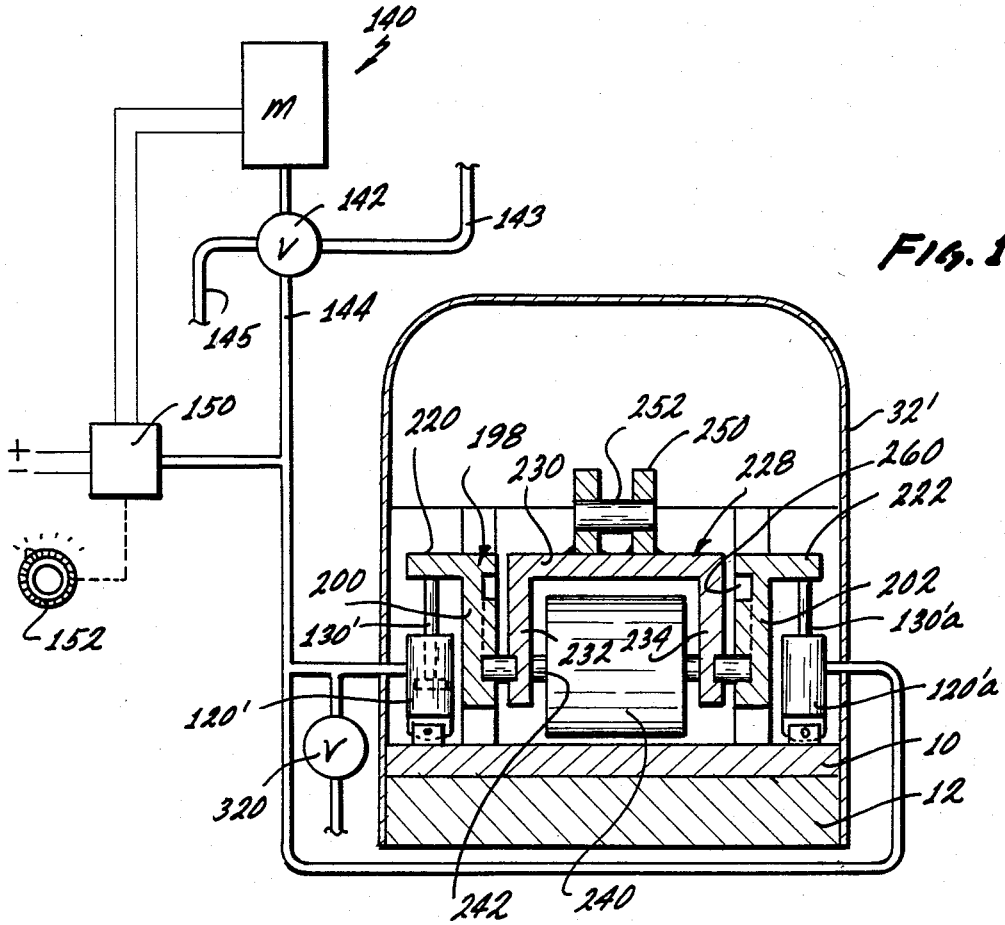
FIG. 12 is a sectional view taken along 12—12 of FIG. 9.

The side members 200 and 202 each have extending lugs which are in pairs, one pair being designated at 220 and 222 in FIG. 12. These pairs of lugs are alike.

Carried by the frame 198 is another frame or secondary frame which is designated by the numeral 228. This frame has a top as may be seen at 230 in FIG. 12 and depending side walls 232 and 234.

Mounted between the side walls 232 and 234 are a plurality of rollers which are like the rollers of the first embodiment described above. One of these rollers is designated at 240 all of them being alike. The roller 240 is mounted on the shaft 242 extending between the side plates 232 and 234. The rollers are mounted in a position to provide a clearance betwen them and the die plate 10 like that of the first embodiment. The top 230 of the frame 228 has a window 246 in it to allow the incoming material to be densified to drop down on to the die plate 10. The top also has a pair of lugs forming a yoke as designated at 250 having a pivot or stem 252 in between the legs of the yoke for purposes of attachment to an operating cylinder as will be described.

Figure 9:
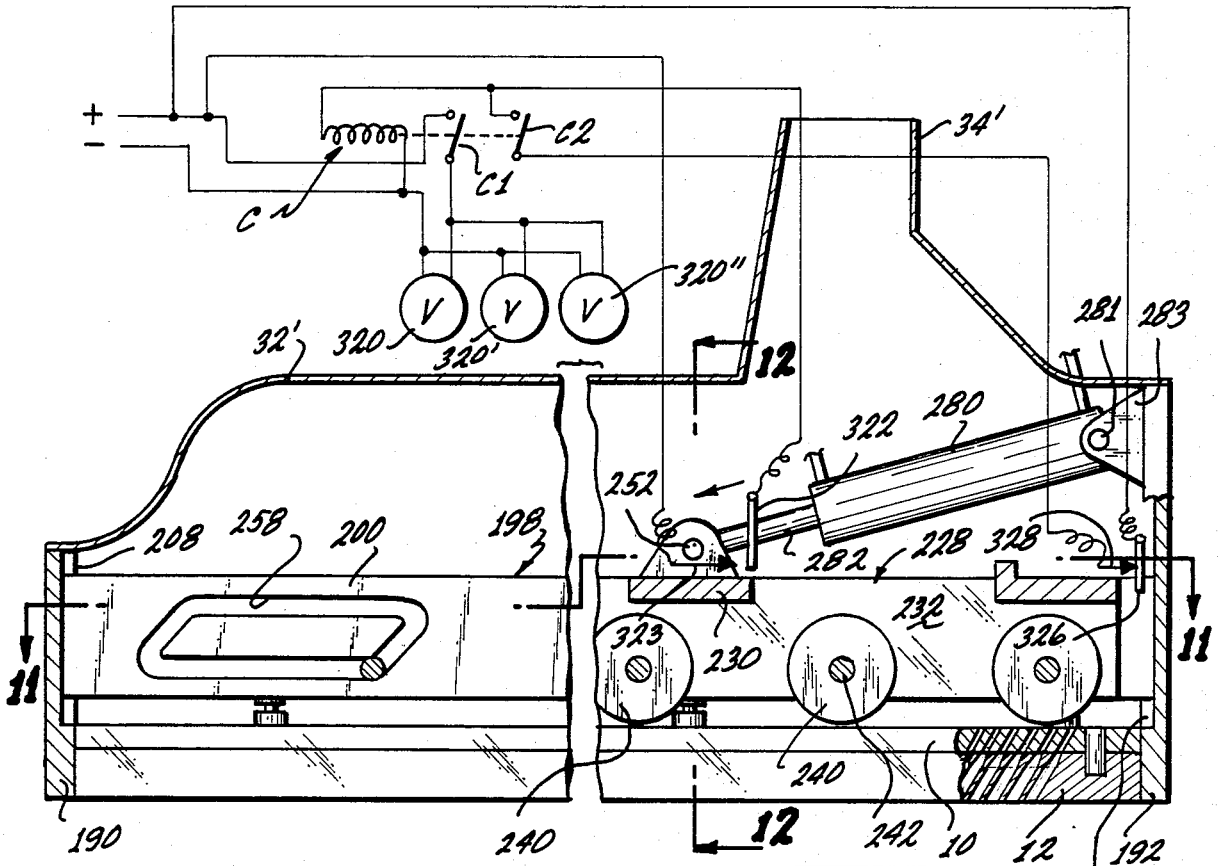
FIG. 9 is a longitudinal sectional view of a modified form of the invention including circuitry controlling the cylinder which reciprocates the roller frame.
Figure 10:
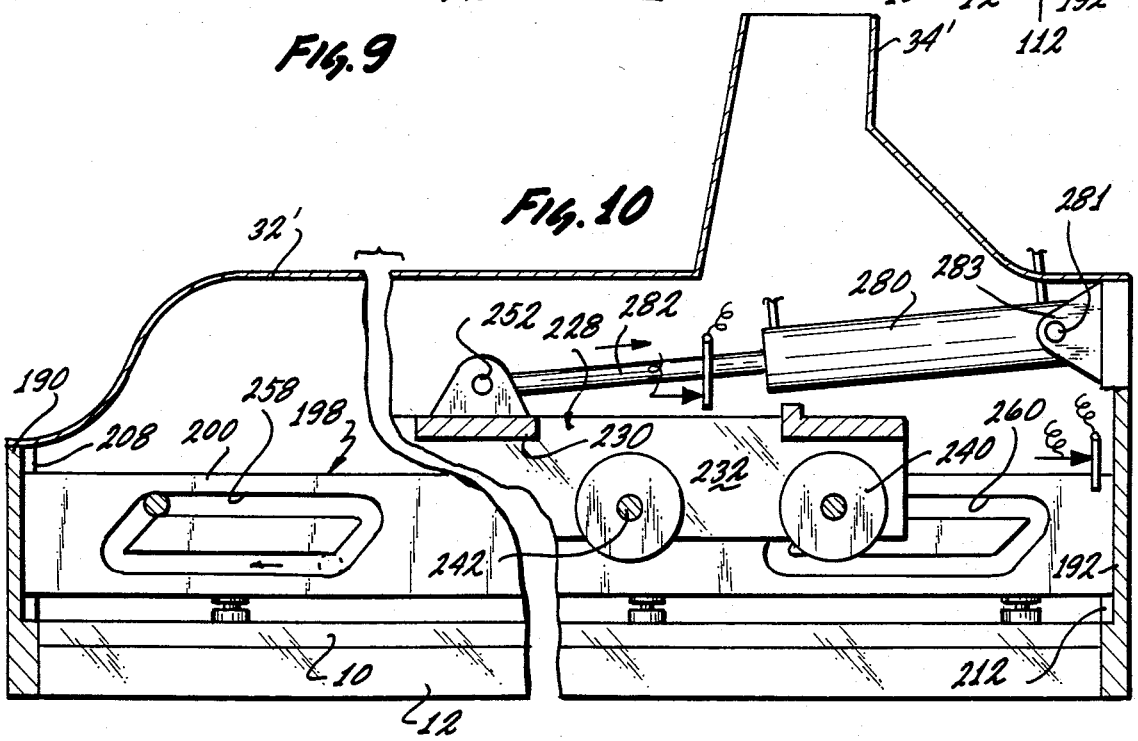
FIG. 10 is a longitudinal sectional view of the form of the invention shown in FIG. 9 showing the frame carrying the rollers in an extended and lifted position.

The frame 228 carrying the rollers is reciprocated over the die plate 10 between positions as illustrated in FIGS. 9 and 10. In one direction of movement the frame 228 is in a position so that the rollers exert downward force on the material to be densified and pelletized. In the other direction of reciprocation, the frame with the rollers is lifted.

The mechanism for causing the frame 228 to be lifted is illustrated in the figures. As may be seen in the figures the frame plate 200 has a recessed cam track in it as designated by the numeral 258 having a shape as may be seen in FIGS. 9 and 10. This recessed cam track has parallel upper and lower parts and parallel end parts at an angle as shown. The plate 200 has a second similar recessed cam track, as designated at 260 in FIG. 9. The other frame plate 202 has similar recessed cam tracks in it as designated at 262 and 264. See FIG. 11.

The shafts of two of the rollers like the rollers 240 are extended beyond the side plates 228 and 234 so that the ends of these shafts form cam followers. They are able to follow in the recessed cam tracks 258, 260, 262, and 264. One of these rollers is designated by the numeral 270 the shaft being designated by the numeral 272 and its ends forming cam followers as designated by the numerals 274 and 276. As stated, these cam followers are formed by the ends of the shafts of two of the rollers like rollers 240 and 270, to follow in cam tracks 258 and 260.

FIGS. 9 and 10 illustrate the position of the frame 228 in its reciprocated positions. As can be seen, as the frame is moving to the left the cam followers like followers 274 and 276 follow along in the bottom parallel reaches of the cam tracks 258–262. At the end of the stroke the cam follower members as described move up in the left end part of the respective cam tracks and when the frame carrying the rollers is retracted the cam followers as described follow along in the upper parallel reaches of the respective cam tracks, the operation being illustrated in FIGS. 9 and 10.

The reciprocating movement of the frame 228 is accomplished by means of a pressure cylinder 280. This cylinder is a double ended cylinder which may actuated either by pneumatic or hydraulic pressure. It has a stem 282 which connects to the pin 252 of the yoke 250 on the top 230 of frame 228. The cylinder is mounted to allow pivoting movement by way of pin 281 carried by yoke 283 on wall 192.

The doubled ended cylinder 280 is controlled by two three-way valves V1 and V2 which are electricaly controlled by switches which are actuated by movement of the roller frame 228 as may be seen in FIG. 9. Valve V1 has an inlet 284 and outlet pipe 286 connecting to one end of the cylinder 280 and a further outlet 288. The valve V2 has an inlet 290 and outlet 292 which connects to the other end of cylinder 280 and another outlet 294. Each valve has tow positions. In one position it admits pressure to its respective end of the cylinder 280 and in the other position releases pressure from that end. This control systems is shown in FIG. 9A.

The valve V1 and V2 are electrical and are controlled by a first single pole, double throw switch 300 having contacts 301 and 302 and a second single pole, double throw switch 304 having contacts 305 and 306.

Relay A controls valve V1 and relay B controls valve V2. Relay A has a first contact A1 controlling valve V1 and a second contact A2 which forms a holding circuit for relay A. Relay B has a first contact B1 which controls V2 and second contact B2 which forms a holding cirucuit for relay B.

Figure 9A:
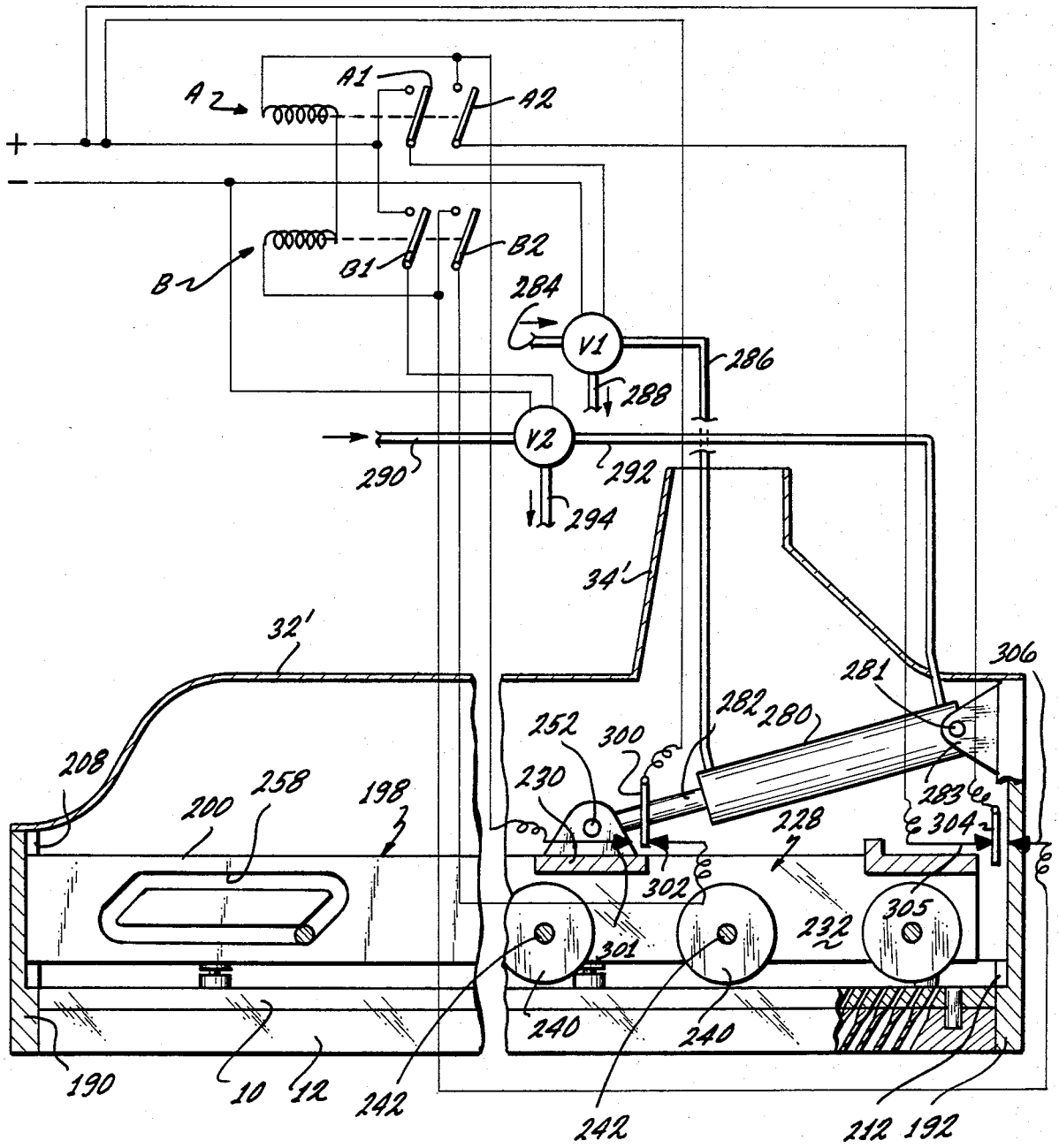
FIG. 9A is a view similar to FIG. 9 showing the control circuitry for the release valves associated with the hold down cylinders.
Figure 11:
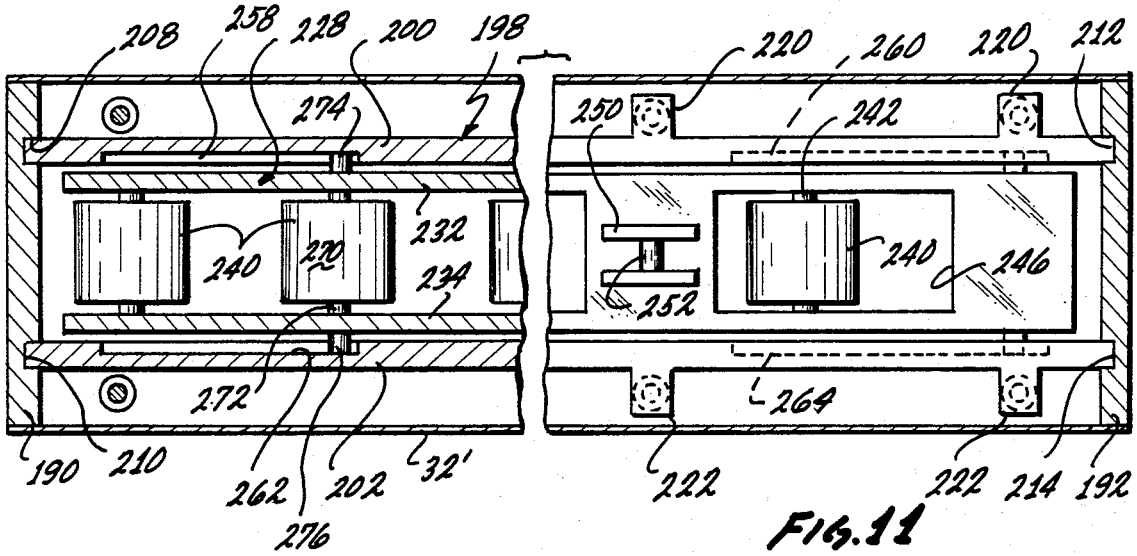
FIG. 11 is a sectional view taken along 11—11 of FIG. 9.

In the position shown in FIG. 9A the valve V2 is to be energized to cause the cylinder 28 to operate to shift the frame 228 to the left. In this position the movement of the frame acts on switch 304 to close contact 306 which energizes relay B. Its contact B1 now energizes valve V2 admitting fluid to the right end of cylinder 280. At the same time a holding circuit is formed for relay B through its contact B2 which is through the contact 302 of switch 300.

When the frame 228 has been moved all the way to the left the movement of part 229 of the frame will cause switch 300 to open contact 302 interrupting the holding circuit of relay B causing it to drop out and de-energize valve V2 which now causes fluid to be released from the right end of cylinder 280.

Movement of the frame closes contact 301 which now completes the circuit energizing the winding of relay A. Its contact A1 now energizes valve V1 which admits pressure fluid to the left end of cylinder 280 which now moves to the right retracting the frame 280 to a position as shown in FIG. 10. At the same time a holding circuit is completed for relay A through its contact A2 and contact 305 of switch 304 which holds this relay in until frame is retracted all the way to the right.

As previously described during the advancing reciprocating movement the frame holds the rollers down against the material to be densified and pelletized during the retracting movement. The cam mechanism as described causes the frame and rollers 228 to be lifted and retracted in the return stroke.

In this embodiment of the invention pairs of hold down cylinders are provided as in the first embodiment. The hold down cylinders exert a downward force on the frame 198.

Two of the holding cylinders are designated at 120' and 120a' in FIG. 12, these hold down cylinders being like those of the first embodiment being pivotedly mounted to allow slight lateral tilting movement. In FIG. 12 the stems 130' and 130a' are attached to the lugs 220 and 222 on the frame member 200 and 202. As explained their are three pairs of hold down cylinders and three pairs of these extending lugs on the frame members. See FIG. 11.

The pressure in the hold down cylinders is controlled by a modulating or proporting type of control system which is just the same as the one described in connection with FIG. 1 and the parts are identified by the same reference chacacters in FIG. 12. A similar control system is provided for each pair of hold down cylinders the controlling instrumentality being capable of having its set point adjusted from a remote station by way of a knob like the knob 152. The hold down cylinders maintain a predetermined controlled force acting on the rollers which act on the material being densified.

In the control system 140 as shown in FIG. 12 an additional valve is provided as designated at 320. The opening of this valve releases the pressure in the hold down cylinders 120' and 120a' into an outlet. This occurs at the end of the working reciprocating stroke in order to allow the frame 228 to be raised by the cam mechanism for retraction. As soon as the frame has been retracted these valves reclose so that the control pressure is reapplied in in the hold down cylinders. There is, of course, a valve like the valve 320 for each of the pairs of hold down cylinders. These valves are controlled by additional switches which are actuated by movement of the roller frame 228. This control system is illustrated in FIG. 9. This figure includes a switch 322 with contact 323 which closes by movement of the frame 228 to its position further to the left. Numeral 326 designates another switch with a contact 328 which is opened when the frame 228 moves to its position furthist to the right.

The valve 320 and two similar valves 320' and 320'' are shown in FIG. 9. They are controlled by relay C having contacts C1 and C2. When the frame 228 moves all the way to the left the switch 322 closes contact 323 energizing relay C. Its contact C1 energizes valves 320, 320', and 320'', which open and release the pressure in all of the pairs of hold down cylinders. Contact C2 completes a holding circuit through contact 238 and switch 326 for relay C to hold it in during the retracting movement. Thus, as the frame 228 is being retracted the frame is allowed to be raised by the cam mechanism during the retracting movement. When the frame reaches its position furthist to the right switch 326 opens its contact 328 opening the holding circuit of relay C causing valves 320, 320' and 320'' to be de-energized and closed so that the controlled hold down pressure is immediately reapplied to the hold down cylinders so that in the next reciprocating stroke to the left the frame 228 and the rollers are held down against the material being densified.

It is possible to operate the system of FIGS. 9–13 without the release valves 320.

From the foregoing those skilled in the art will readily understand the construction and operation of the present form of the invention. It is similar to the first embodiment, however, the rollers are carried on the reciprocating frame rather than on endless link chains. The cam mechanism allows the frame to be raised during the return stroke and again lowered for the advanced stroke. The hold down pressure is applied only during the advanced stroke and is released to allow the frame to raise for the return stroke. The hold down pressure is controlled as in the first embodiment and is automatically released during the return stroke.

From the foregoing those skilled in the art will readily understand the nature of the basic concept of the invention as well as the various embodiments or forms for implementing the concept. It should be understood that variations and alternatives may be adopted in various forms of implementing the concept which is basically unique.

The foregoing disclosure is representative of preferred forms of the invention and is to be interpreted in an illustrative rather than a limiting sense, the invention to be accorded the full scope of the claims appended hereto.

I claim:

1. A machine for densifying and pelletizing extrudable material comprising, in combination, a flat horizontal die plate having spaced extrusion orifices in it, means for delivering material to be densified and pelletized to the surface of said die plate, pressure exerting means overlying said die plate for exerting pressure downwardly directly against the material for densifying it and for causing the material to be pelletized by being extruded through the die plate orifices, said pressure exerting means including continuous chain means positioned over said die plate, said chain means carrying a plurality of spaced pressure members shaped to cause the material to be densified to be extruded through the orifices in said die plate.

2. A machine as in claim 1 wherein said presser members are curved, said curved members having a curvature which is sloped away from said die plate at the leading end portion of said curved members.

3. A machine as in claim 1 wherein said orifices in said die plate are at an angle slanted in the direction of movement of said means for exerting pressure on the material so that the advancing direction of movement of the material is changed by less than 90° as it is extruded through said orifices.

4. A machine for densifying and pelletizing extrudable material comprising, in combination, a flat horizontal die plate having spaced extrusion orifices in it, means for delivering material to be densified and pelletized to the surface of said die plate, pressure exerting means overlying said die plate for exerting pressure downwardly directly against the material for densifying it and for causing the material to be pelletized by being extruded through said die plate orifices, said pressure exerting means including continuous link belt means positioned over said die plate, said belt means carrying a plurality of pressure rollers in position to move them over the surface of said die plate.

5. A machine as in claim 4, including pressure plate means positioned over a reach of the belt means which overlies the die plate and means for exerting force on the pressure plate and against the said link belt means for urging the rollers downwardly against the material on the surface of the die plate.

6. A machine as in claim 5, including roller members carried by the link belt means at positions between adjacent links which bear against the said pressure plate.

7. A machine as in claim 5, including fluid pressure cylinders poistioned to act on the pressure plate means to urge said means against the said link belt means.

8. A machine as in claim 7, including means for supplying fluid pressure to the pressure cylinders and means for controlling pressure in the cylinders whereby to maintain a substantially constant downward force on the pressure plate means.

9. A machine as in claim 8, wherein the fluid pressure cylinders include a plurality of pairs with pressure cylinders spaced along the length of the pressure plate means, and separate pressure contolling means for individual pairs of cylinders.

10. A machine as in claim 9, including pressure fluid cylinders positioned to exert a downward force on the frame means, means for controlling the pressure in the cylinders to maintain predetermined force and automatic means for releasing pressure in the cylinders.

11. A machine for densifying and pelletizing extrudable material comprising in combination, a flat horizontal die plate having spaced extrusion orifices in it, means for delivering material to be densified and pelletized to the surface of the die plate, fluid pressure means overlying the die plate for exerting pressure downwardly directly against the material for densifying it and for causing the material to be pelletized by being extruded through the die plate orifices, said pressure exerting means includes roller means and means for moving said roller means along said die plate over the material, frame means carrying said roller means, means for reciprocating said frame means and roller means relative to said die plate in an advancing direction and a retracting direction and means for applying downward force on said frame means in the advancing direction of movement and released in the retracting direction of movement, wherein said means for reciprocating includes element including cam track means and cam follower means, one of said elements being carried by said frame means, said cam track means and cam follower means allowing movement of said frame means in a generally straight line in one direction and movement of said frame means in a generally straight line in another direction, said one direction of movement in a straight line being inclined relative to said another direction of movement in a straight line, so that said frame means and roller means are lifted in the direction of retracting movement and lowered in the direction of advancing movement.

12. A machine as in claim 11, said means for reciprocating including fluid pressure actuated means for reciprocating said frame and roller means.

13. A machine as in claim 12, wherein said fluid actuated reciprocating means includes fluid pressure actuated cylinder means, and electrically operated valve means for controlling pressure in the cylinder means.

* * * * *